US008087839B2

(12) United States Patent
Takabatake et al.

(10) Patent No.: US 8,087,839 B2
(45) Date of Patent: Jan. 3, 2012

(54) PRINTER WITH FRAME PRODUCED BY PRESS-FORMING SHEET METAL

(75) Inventors: Yoshinari Takabatake, Shinagawa (JP); Tadashi Ohtaka, Shinagawa (JP); Yukihiro Mori, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 882 days.

(21) Appl. No.: 12/078,944

(22) Filed: Apr. 8, 2008

(65) Prior Publication Data

US 2009/0103963 A1 Apr. 23, 2009

(30) Foreign Application Priority Data

Oct. 17, 2007 (JP) ..... 2007-270141

(51) Int. Cl.
*B41J 29/02* (2006.01)
*B41J 13/10* (2006.01)

(52) U.S. Cl. ..... 400/691; 400/642

(58) Field of Classification Search ..... 400/691, 400/120.01, 120.16, 642; 347/197
See application file for complete search history.

(56) References Cited

U.S. PATENT DOCUMENTS

| | | | | |
|---|---|---|---|---|
| 4,944,621 | A * | 7/1990 | Uecker | 400/691 |
| 5,106,212 | A * | 4/1992 | Endo et al. | 400/120.16 |
| 5,255,989 | A * | 10/1993 | Berthold et al. | 400/605 |
| 7,114,805 | B2 * | 10/2006 | Niikura | 347/108 |
| 2005/0036820 | A1 * | 2/2005 | Watanabe et al. | 400/621 |

FOREIGN PATENT DOCUMENTS

| | | | |
|---|---|---|---|
| JP | 2004130724 | A * | 4/2004 |
| JP | 2005-59395 | | 3/2005 |

* cited by examiner

*Primary Examiner* — Daniel J Colilla
(74) *Attorney, Agent, or Firm* — Staas & Halsey LLP

(57) ABSTRACT

A disclosed printer includes a frame; a thermal head attached to the frame; a platen roller drive motor attached to the frame; a reduction gear train attached to the frame and configured to reduce the speed of rotation generated by the platen roller drive motor; and a platen roller detachably attached to the frame and configured to be driven by the platen roller drive motor via the reduction gear train and to feed paper while pressing the paper against the thermal head. The frame is produced by press-forming sheet metal and includes a horizontal plate part, a backboard part rising vertically from a back edge of the horizontal plate part, sideboard parts rising vertically from corresponding side edges of the horizontal plate part, and a projecting part protruding outward from an edge of one of the sideboard parts and forming a surrounding part of a gearbox.

8 Claims, 13 Drawing Sheets

PRINTER WITH FRAME PRODUCED BY PRESS-FORMING SHEET METAL

BACKGROUND OF THE INVENTION

1. Field of the Invention

The present invention generally relates to a printer. More particularly, the present invention relates to a thermal printer including a frame, a thermal head, a detachable platen roller, and a platen roller drive motor.

2. Description of the Related Art

FIGS. 1, 2, and 3 show a conventional thermal printer 1. In FIGS. 1, 2, and 3, X1-X2 shows the width direction, Y1-Y2 shows the depth direction, and Z1-Z2 shows the height direction of the thermal printer 1. The thermal printer 1 includes a die-cast zinc frame 2. The frame 2 includes a body 3 long in the X direction, sideboards 4 and 5 at the corresponding sides of the body 3, and shafts 6 protruding from the sideboard 4. The sideboards 4 and 5, respectively, have substantially U-shaped bearings 7 and 8 and recesses 9 for holding platen roller holding springs 12 and 13. A paper guide 10, thermal-head-pressing plate springs 11, the platen roller holding springs 12 and 13 made by bending wire springs, and a gearbox cover 14 are fixed to the frame 2. The thermal printer 1 also includes a thermal head 20, a platen roller drive motor 30, a reduction gear train 40, and a platen roller 50.

The thermal head 20 is disposed parallel to the body 3 of the frame 2 with the corresponding ends of the thermal head 20 fitted into the sideboards 4 and 5. The thermal head 20 is biased toward the Y2 direction by the thermal-head-pressing plate springs 11. The platen roller drive motor 30 is fixed to the inner surface of the sideboard 4 and is disposed at the Y1 side of the body 3. Gears constituting the reduction gear train 40 are supported by the shafts 6. The gearbox cover 14 is attached to the X1 side of the sideboard 4 to cover the reduction gear train 40. The platen roller 50 has shafts 51 and 52 protruding from the corresponding ends. Bearing parts 53 and 54 fitted around the shafts 51 and 52 are placed in the bearings 7 and 8, respectively. The platen roller holding springs 12 and 13, respectively, press the bearing parts 53 and 54 and thereby hold them in the bearings 7 and 8. Thus, the platen roller 50 is detachably attached to the frame 2.

[Patent document 1] Japanese Patent Application Publication No. 2005-059395

Conventionally, frames of thermal printers are produced by die-casting. This makes it necessary to remove burrs formed during the die-casting process from the frames. Furthermore, burrs that cannot be removed by abrasive blasting have to be removed manually. Thus, producing a frame of a thermal printer by die-casting increases the number of steps and the workload to produce the thermal printer.

Also, producing a frame by die-casting may cause porosity in the frame which results in reduced strength of the frame.

In addition, die-casting dies are expensive and therefore increase the equipment cost.

Further, using a die-cast frame increases the number of parts of a thermal printer. For example, the conventional thermal printer 1 described above requires the paper guide 10, the thermal-head-pressing plate springs 11, and the platen roller holding springs 12 and 13 in addition to the frame 2.

SUMMARY OF THE INVENTION

Embodiments of the present invention provide a printer that solves or reduces one or more problems caused by the limitations and disadvantages of the related art.

An embodiment of the present invention provides a printer that includes a frame; a thermal head for printing, the thermal head being attached to the frame; a platen roller drive motor attached to the frame; a reduction gear train attached to the frame and configured to reduce the speed of rotation generated by the platen roller drive motor; and a platen roller detachably attached to the frame and configured to be driven by the platen roller drive motor via the reduction gear train and to feed paper while pressing the paper against the thermal head. The frame is produced by press-forming sheet metal and includes a horizontal plate part having a rectangular shape, a backboard part rising vertically from a back edge of the horizontal plate part, sideboard parts rising vertically from corresponding side edges of the horizontal plate part, and a projecting part protruding outward from an edge of one of the sideboard parts and forming a surrounding part of a gearbox for housing the reduction gear train.

DETAILED DESCRIPTION OF THE PREFERRED EMBODIMENTS

Preferred embodiments of the present invention are described below with reference to the accompanying drawings.

Figure 4:
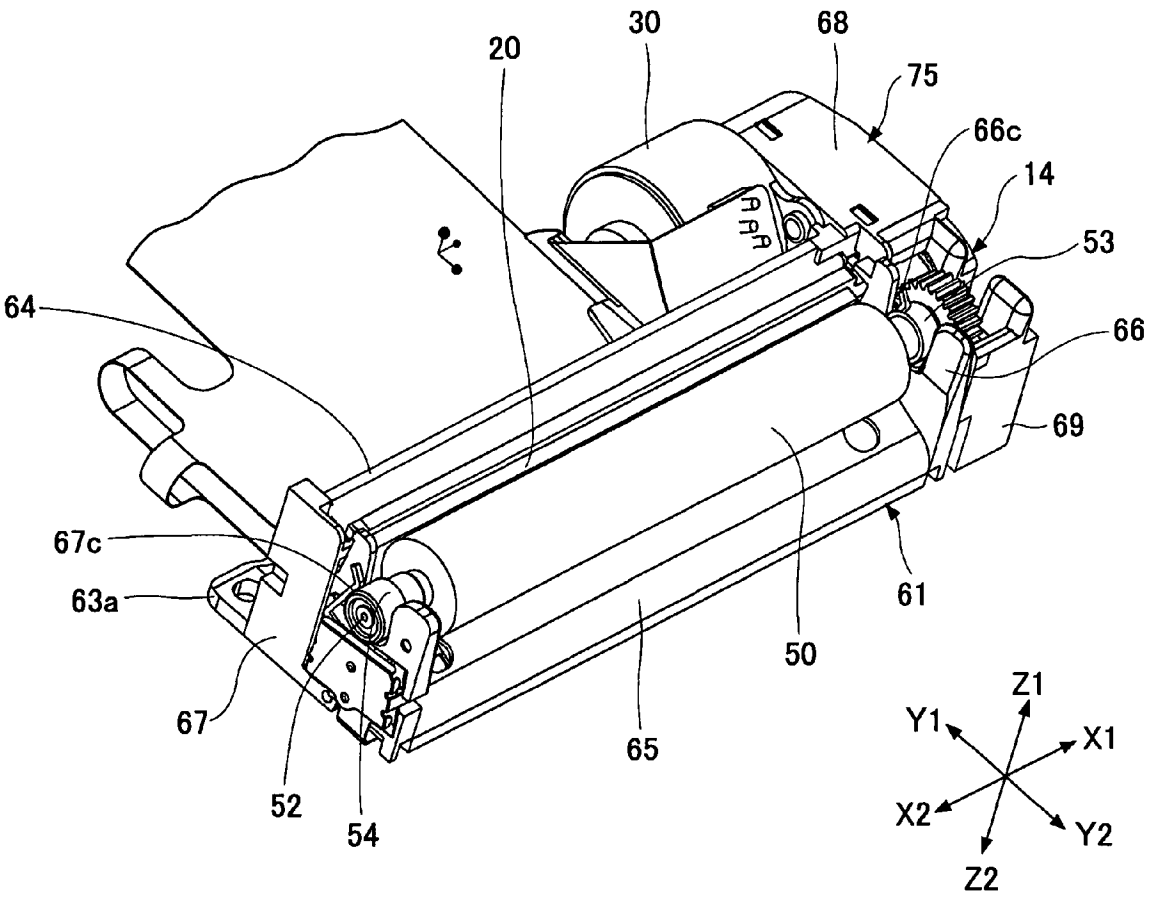
FIG. 4 is a perspective view of a thermal printer 60 according to an embodiment of the present invention.
Figure 5:
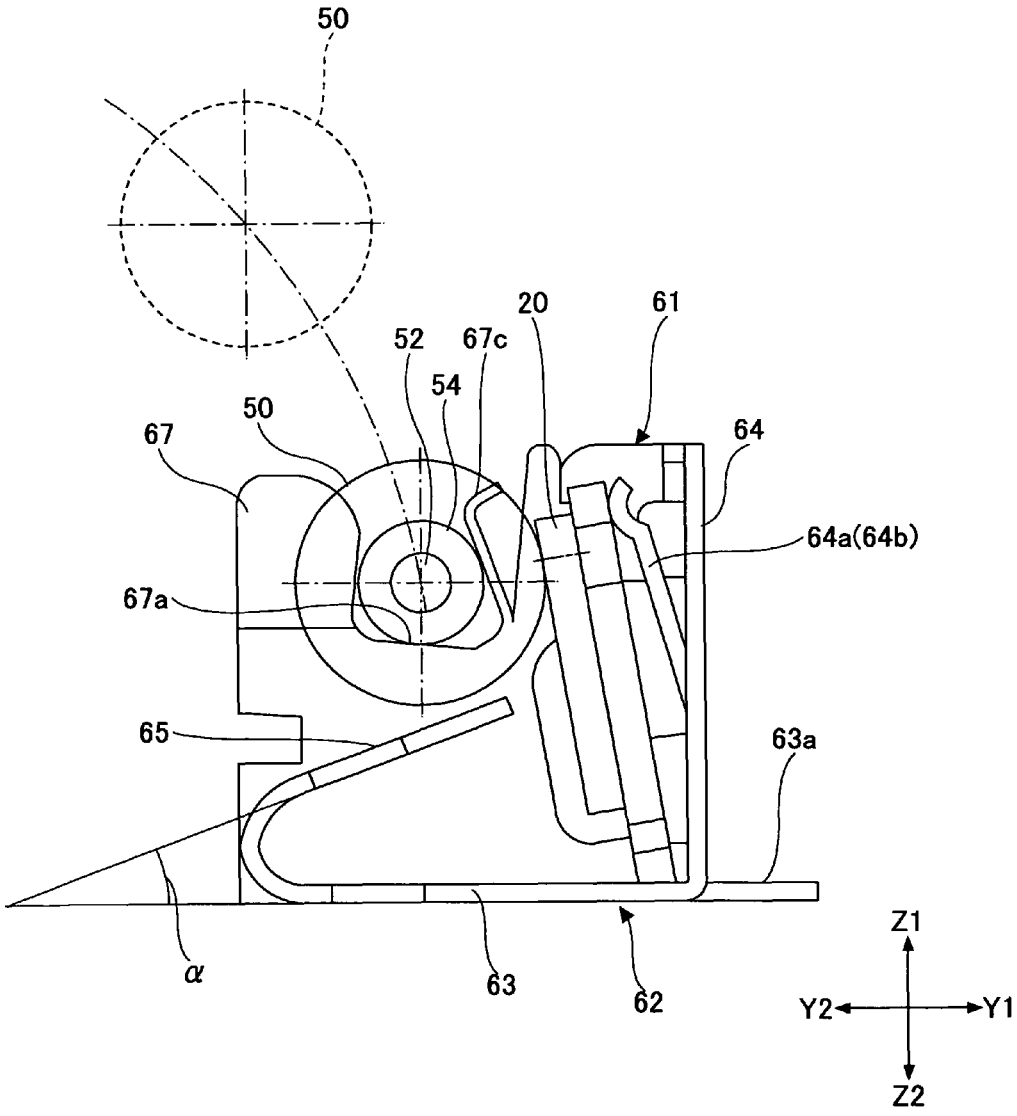
FIG. 5 is an enlarged cut-away side view of the thermal printer 60 shown in FIG. 4.
Figure 6:
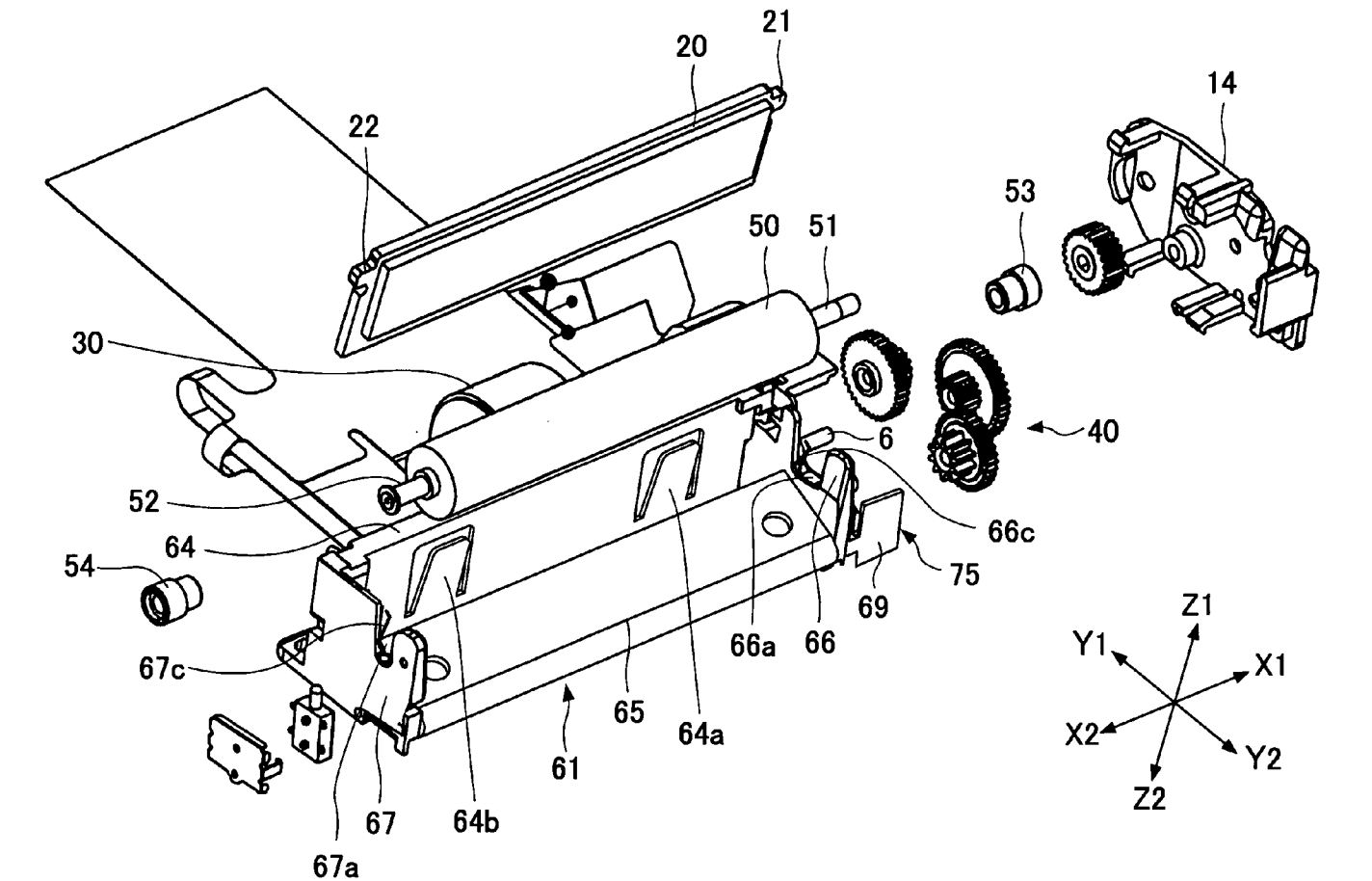
FIG. 6 is an exploded perspective view of the thermal printer 60 shown in FIG. 4.
Figure 7:
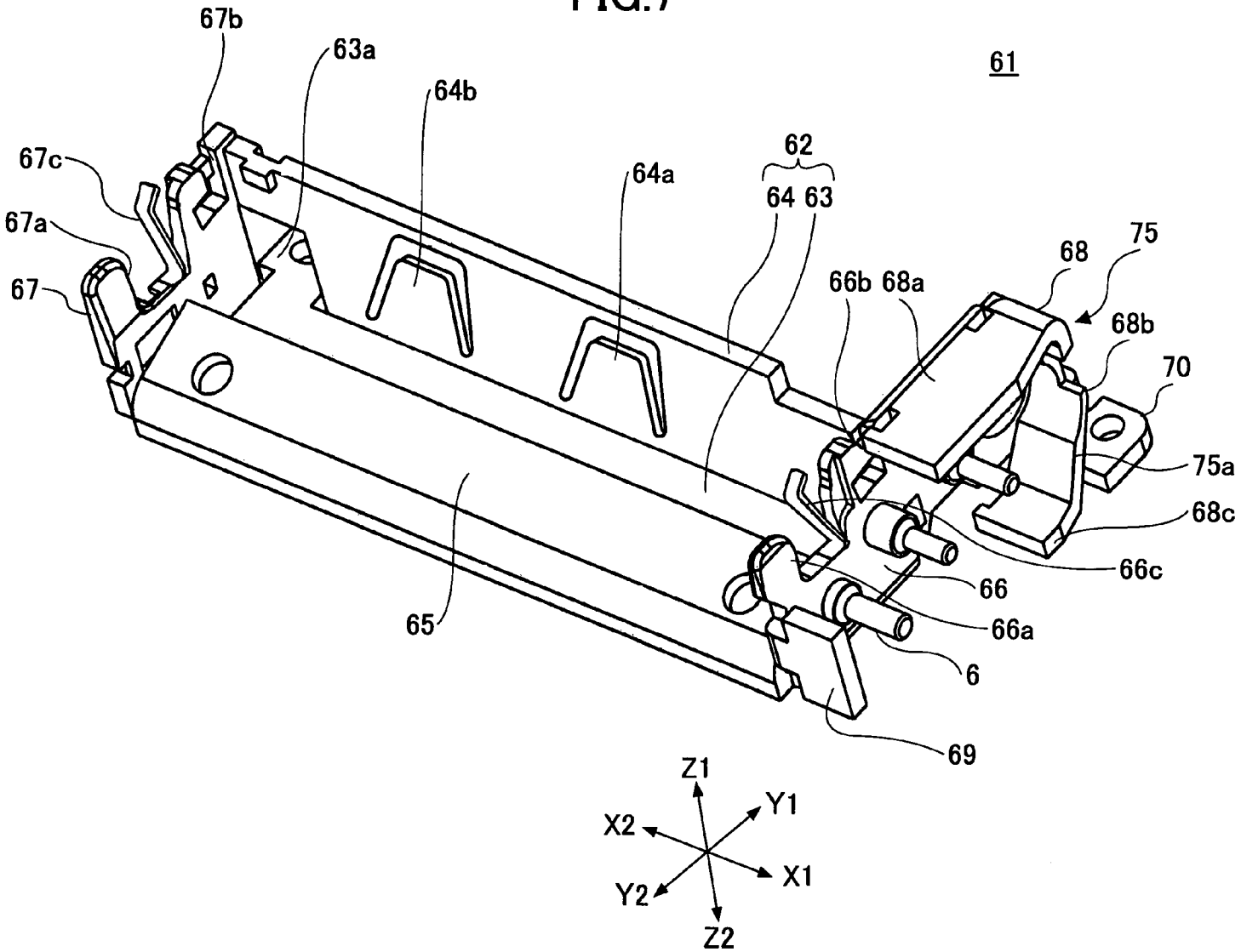
FIG. 7 is a perspective view of a frame 61 of the thermal printer 60 shown in FIG. 4.

FIG. 4 is a perspective view of a thermal printer 60 according to an embodiment of the present invention. FIG. 5 is an enlarged cut-away side view of the thermal printer 60. FIG. 6 is an exploded perspective view of the thermal printer 60. FIG. 7 is a perspective view of a frame 61 of the thermal printer 60.

In figures, X1-X2 shows the width direction, Y1-Y2 shows the depth direction, and Z1-Z2 shows the height direction of the thermal printer 60. Also, Y1 indicates the back side and Y2 indicates the front side of the thermal printer 60.

Figure 1:
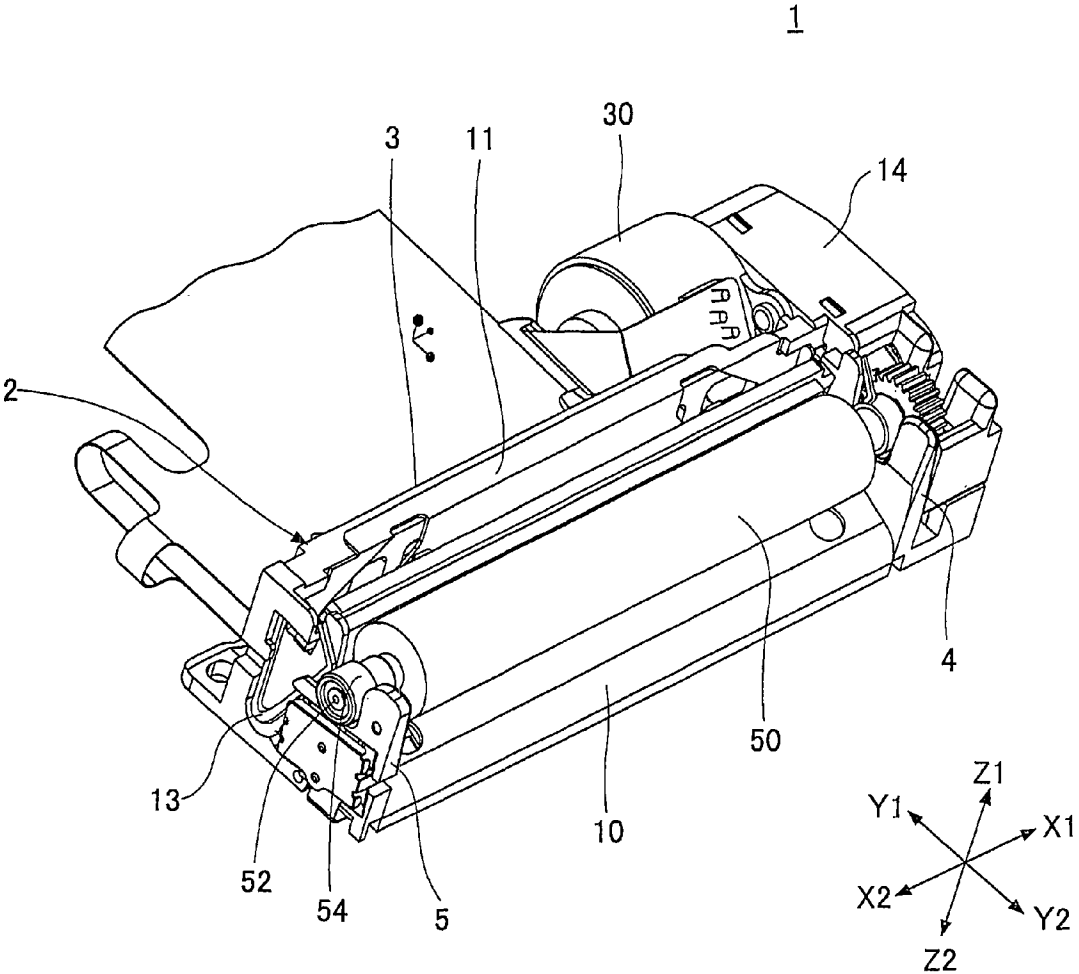
FIG. 1 is a perspective view of a conventional thermal printer.

The thermal printer 60 is different from the conventional thermal printer 1 of FIG. 1 mainly in the configuration and production method of the frame 61. The thermal printer 60 includes the frame 61, a thermal head 20 for printing, a platen roller drive motor 30, and a platen roller 50 that feeds paper while pressing it against the thermal head 20. The platen roller 50 is detachably attached to the frame 61 and a reduction gear train 40. The reduction gear train 40 reduces the speed of rotation generated by the platen roller drive motor 30 and transmits the rotation. When attached to the frame 61, the platen roller 50 is driven by the platen roller drive motor 30 via the reduction gear train 40. The reduction gear train 40 is housed in a gearbox 75 and the X1-side opening of the gearbox 75 is covered by a gearbox cover 14.

The frame 61 is produced by press-forming a stainless steel plate as shown in FIGS. 8A through 9C. The frame 61 includes a horizontal plate part 63, a backboard part 64, a paper guide part 65, a sideboard part 66, a sideboard part 67, a projecting part 68, a projecting part 69, and a fixing leg 70. The horizontal plate part 63 has a rectangular shape that is long in the X direction. The backboard part 64 rises vertically from the Y1 edge (back edge) of the horizontal plate part 63. The paper guide part 65 rises from the Y2 edge (front edge) of the horizontal plate part 63 and bends backward at an angle a to extend diagonally above the horizontal plate part 63. The paper guide part 65 is positioned below the platen roller 50 and guides paper being fed toward the thermal head 20. The sideboard part 66 rises vertically from the X1 edge (side edge) of the horizontal plate part 63. The sideboard part 67 rises vertically from the X2 edge (side edge) of the horizontal plate part 63. The projecting part 68 protrudes at a right angle from the Z1 edge (upper edge) of the sideboard part 66 in the X1 direction, and thus forms an L-shape with the sideboard part 66. The projecting part 69 protrudes at a right angle from the Y2 edge of the sideboard part 66 in the X1 direction. The fixing leg 70 protrudes at a right angle from the Z2 edge near the Y1 edge of the sideboard part 66 in the X1 direction.

The horizontal plate part 63 and the backboard part 64 constitute a body 62 of the frame 61.

The horizontal plate part 63 has a fixing leg 63*a* near the X2 end. The fixing leg 63*a* protrudes in the Y1 direction.

The X1 and X2 ends of the backboard part 64 are fitted into or riveted to the corresponding sideboard parts 66 and 67.

Thermal-head-pressing plate springs 64*a* and 64*b* are formed by cutting out portions of the backboard part 64 and pulling up the cut-out portions in the Y2 direction. The thermal-head-pressing plate springs 64*a* and 64*b* press the backside of the thermal head 20 toward the platen roller 50.

The sideboard parts 66 and 67 have substantially U-shaped bearings 66*a* and 67*a*, recesses 66*b* and 67*b*, and platen-roller-holding plate springs 66*c* and 67*c* at their respective Z1 ends. The bearings 66*a* and 67*a* support bearing parts 53 and 54 provided at the corresponding ends of the platen roller 50. The recesses 66*b* and 67*b*, respectively, hold protrusions 21 and 22 of the thermal head 20. The platen-roller-holding plate springs 66*c* and 67*c*, respectively, extend diagonally from the Y1-Z2 corners of the bearings 66*a* and 67*a* in the Z1 direction, and hold the bearing parts 53 and 54 in the bearings 66*a* and 67*a*.

The sideboard part 66 and the projecting parts 68 and 69 constitute the gearbox 75 for housing the reduction gear train 40. Specifically, the sideboard part 66 forms the bottom of the gearbox 75, and the projecting parts 68 and 69 form a surrounding part 75*a* of the gearbox 75.

The projecting part 68 includes a horizontal part 68*a* at the Z1 side, an upright part 68*b* extending from the horizontal part 68*a*, and a horizontal part 68*c* at the Z2 side and extending from the upright part 68*b*.

Shafts 6 are press-fit into or riveted to the outer surface of the sideboard part 66.

<Press-Forming Process of Frame 61>

Figure 8A:
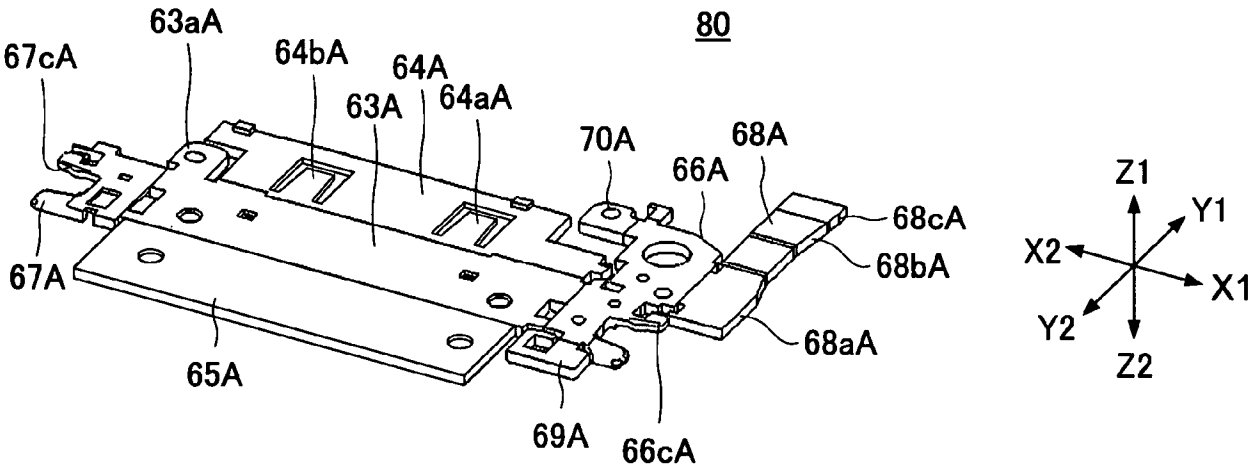
FIGS. 8A through 8D are drawings illustrating a first half of a press-forming process of the frame 61 shown in FIG. 7.

FIG. 8A shows a plate material 80 formed by press-cutting a stainless steel plate. Reference numbers assigned to parts of the plate material 80 are generated by adding a suffix "A" to the reference numbers of the corresponding parts of the frame 61.

In a part 64A corresponding to the backboard part 64, parts 64*a*A and 64*b*A corresponding to the thermal-head-pressing plate springs 64*a* and 64*b* are formed. In a part 66A corresponding to the sideboard part 66, a part 66*c*A corresponding to the platen-roller-holding plate spring 66*c* is formed. In a part 67A corresponding to the sideboard part 67, a part 67*c*A corresponding to the platen-roller-holding plate spring 67*c* is formed.

Figure 8B:
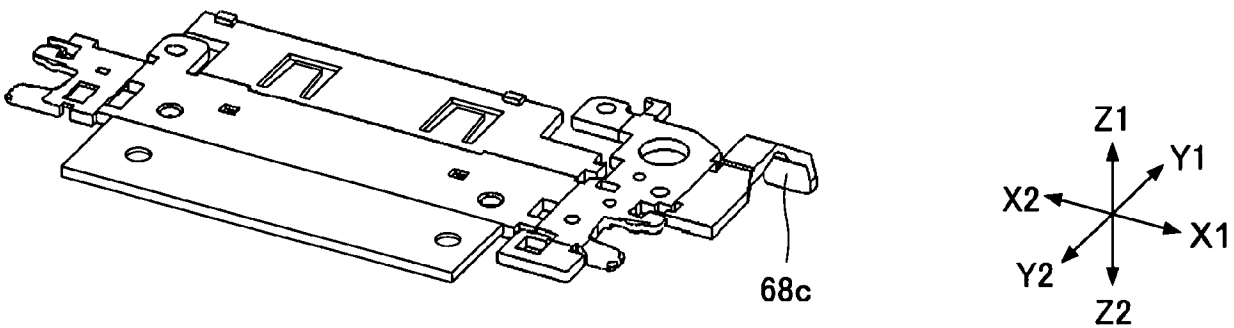
Figure 8C:
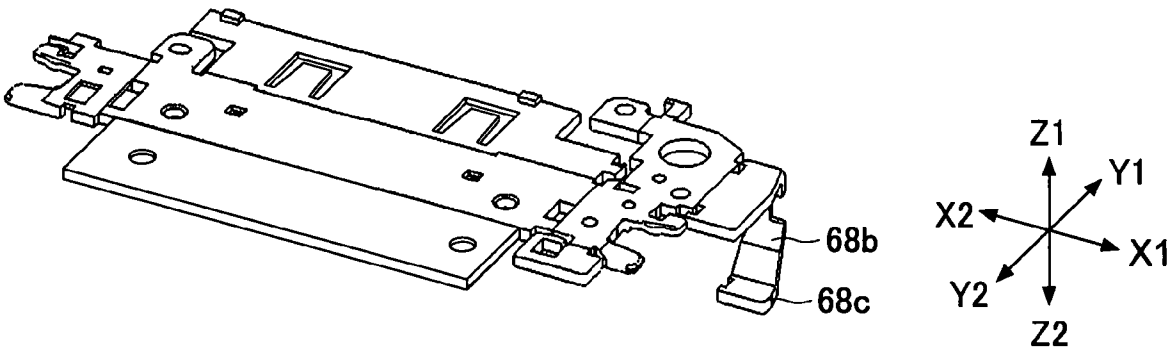

First, parts 68*c*A and 68*b*A are bent as shown in FIGS. 8B and 8C.

Figure 8D:
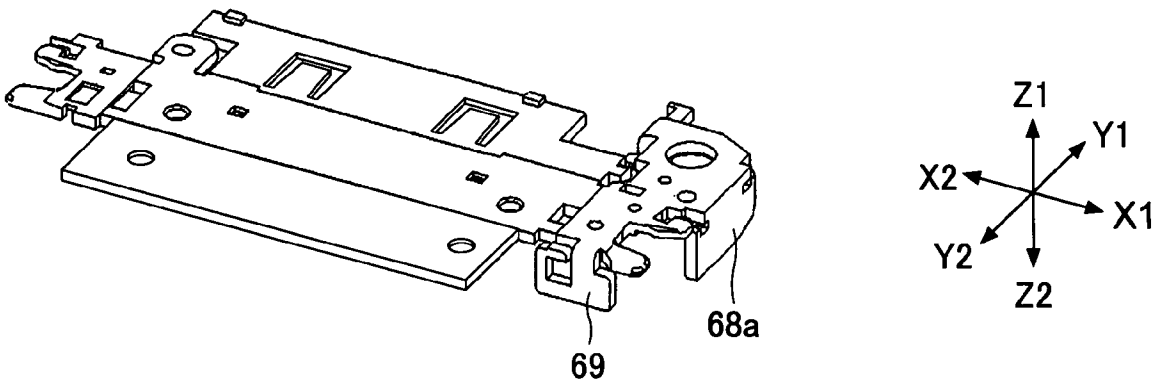

Next, parts 68*a*A, 69A, and 70A are bent as shown in FIG. 8D.

Figure 9A:
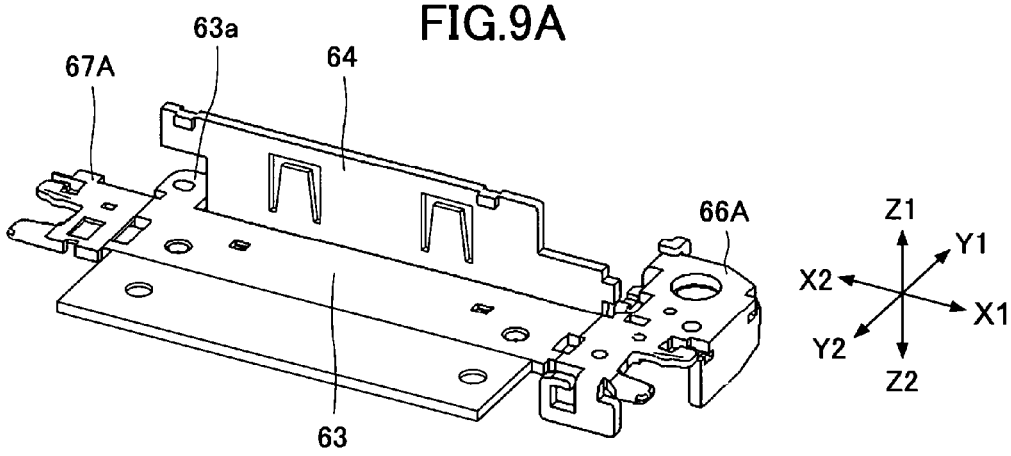
FIGS. 9A through 9C are drawings illustrating a second half of the press-forming process of the frame 61 shown in FIG. 7.

Then, the part 64A is bent up to form the backboard part 64 as shown in FIG. 9A.

Figure 9B:
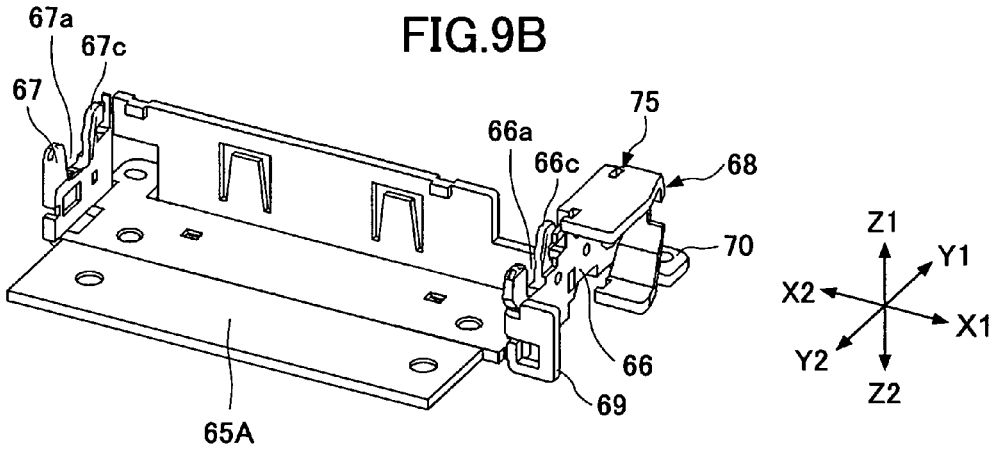

After forming the backboard part 64, the parts 66A and 67A are bent up to form the sideboard parts 66 and 67 as shown in FIG. 9B.

Figure 9C:
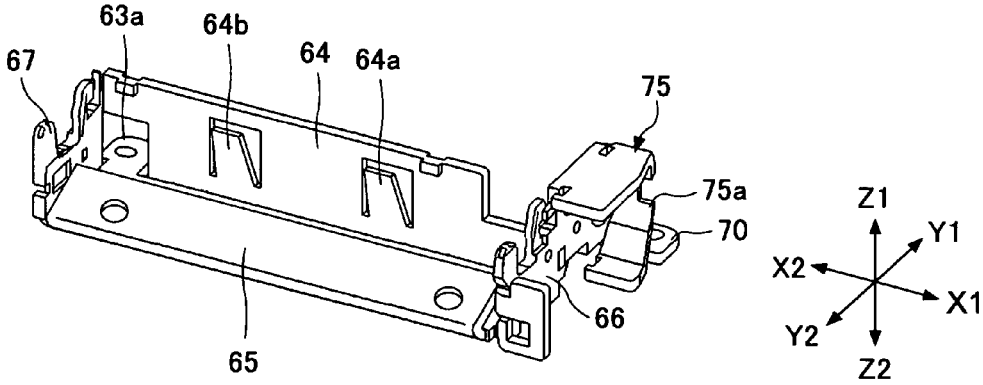

Next, as shown in FIG. 9C, a part 65A is bent up and folded back to form the paper guide part 65 extending above the horizontal plate part 63; and the parts 64*a*A and 64*b*A are bent in the Y2 direction to form the thermal-head-pressing plate springs 64*a* and 64*b*. Then, the shafts 6 are fixed (e.g., riveted) to the outer surface of the sideboard part 66. Thus, the frame 61 shown in FIG. 7 is formed through the above steps.

<Attaching Other Parts to Frame 61>

As shown in FIGS. 4 through 6, the thermal head 20 is disposed at the Y2 side of the backboard part 64 with the protrusions 21 and 22 fit into the recesses 66*b* and 67*b*. The thermal head 20 is pressed by the thermal-head-pressing plate springs 64*a* and 64*b* in the Y2 direction.

The platen roller drive motor 30 is fixed to the inner surface of the sideboard part 66.

Gears constituting the reduction gear train 40 are supported by the shafts 6. The gearbox cover 14 is attached to the ends of the projecting parts 68 and 69 to cover the reduction gear train 40.

The platen roller 50 is attached to the frame 61 by placing the bearing parts 53 and 54, which are fitted around shafts 51 and 52 protruding from the corresponding ends of the platen roller 50, in the corresponding bearings 66*a* and 67*a*. The platen-roller-holding plate springs 66*c* and 67*c*, respectively, press the bearing parts 53 and 54 and thereby hold them in the bearings 66*a* and 67*a*.

The path (or insertion angle) of feeding thermal paper into the thermal printer 60 differs depending on a target apparatus on which the thermal printer 60 is to be mounted. Therefore, in the case of a conventional thermal printer including a paper guide as a separate part, adapting the thermal printer for a different target apparatus involves producing a new paper guide having a different inclination angle and is therefore burdensome. On the other hand, the thermal printer 60 of this embodiment can be easily adapted for a different target apparatus by just changing the bending angle of the part 65A shown in FIGS. 9B and 9C and thereby changing the angle a (see FIG. 5) of the paper guide part 65.

<Variations of Frame 61>

Variations of the frame 61 of the thermal printer 60 are described below.

Figure 10:
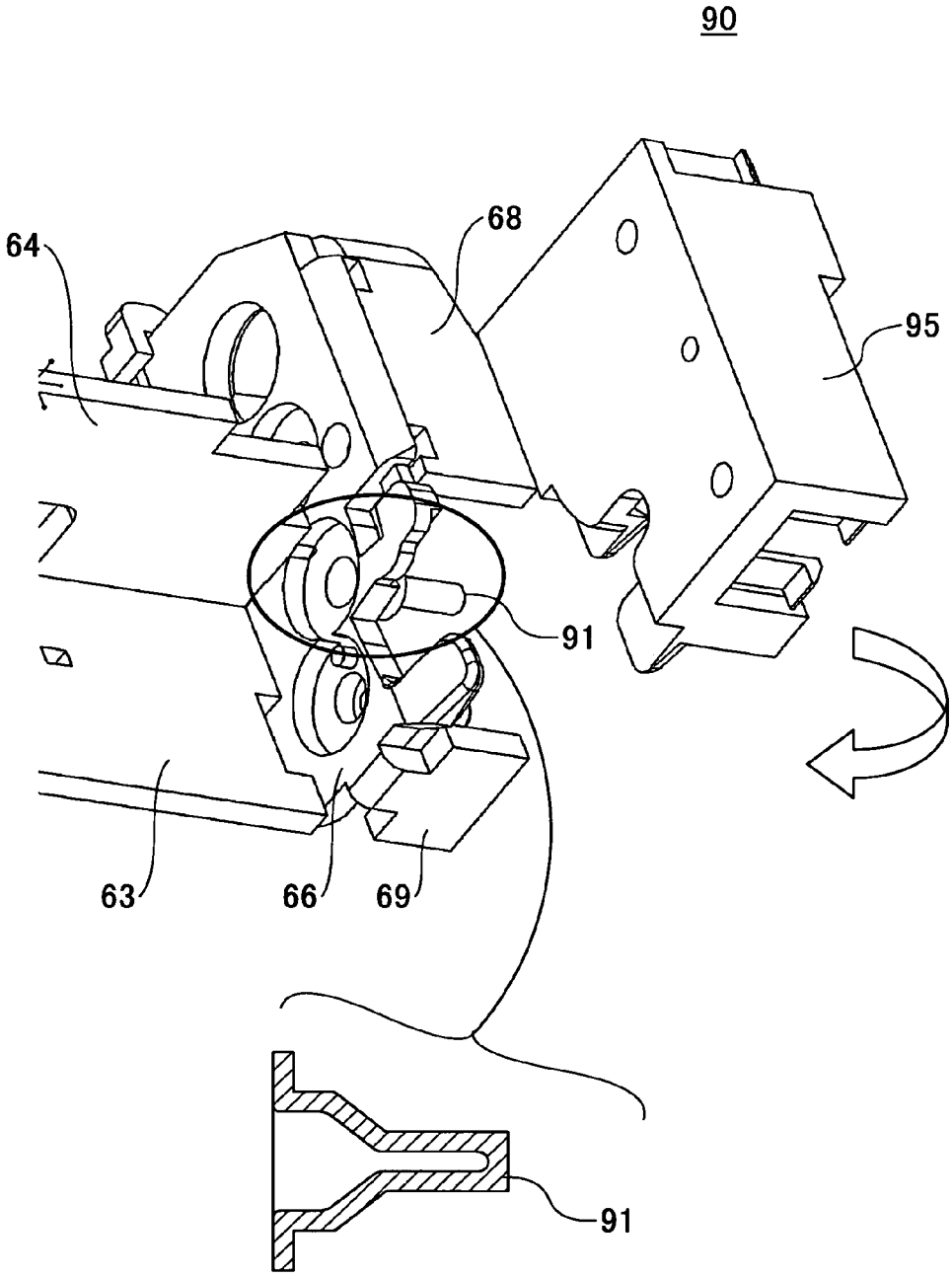
FIG. 10 is a drawing illustrating a frame 90 that is a first variation of the frame 61.

FIG. 10 is a drawing illustrating a part of a frame 90 that is a first variation of the frame 61.

In the frame 90 shown in FIG. 10, instead of the shafts 6, shaft parts 91 are formed in the sideboard part 66 by drawing (a process of shaping sheet metal into a three-dimensional form) or punching.

Also, instead of the gearbox cover 14, a gearbox cover part 95 extending from the projecting part 68 is formed by press-forming. The gearbox cover part 95 is bent with respect to the projecting part 68 in a direction indicated by an arrow shown in FIG. 10 to cover the reduction gear train 40.

The shaft parts 91 may instead be formed in the gearbox cover part 95 by drawing or punching.

Figure 11:
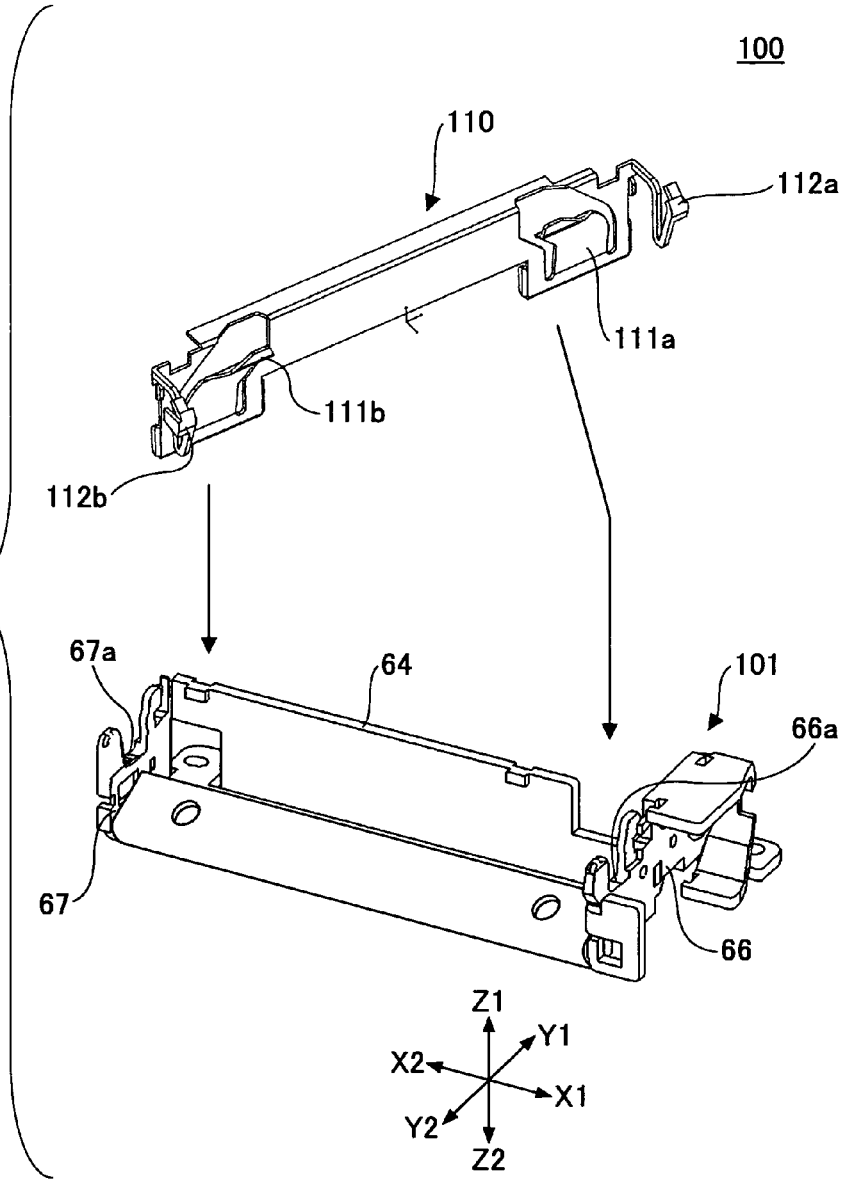
FIG. 11 is an exploded view of a frame 100 that is a second variation of the frame 61.

FIG. 11 is an exploded view of a frame 100 that is a second variation of the frame 61.

The frame 100 includes a frame body 101 made by press forming and a plate spring part 110 attached to the frame body 101. The frame body 101 has a configuration similar to that of the frame 61 shown in FIG. 9C except that the frame body 101 does not have the thermal-head-pressing plate springs 64*a* and 64*b* and the platen-roller-holding plate springs 66*c* and 67*c*. The frame body 101 may be made of aluminum because it has no plate spring.

The plate spring part 110 has thermal-head-pressing plate springs 111*a* and 111*b* and platen-roller-holding plate springs 112*a* and 112*b*. The platen-roller-holding plate springs 112*a* and 112*b* are formed at the corresponding ends of the plate spring part 110.

The plate spring part 110 is attached to a backboard part 64 of the frame body 101 such that the thermal-head-pressing plate springs 111*a* and 111*b* are arranged on the Y2 side of the backboard part 64 and the platen-roller-holding plate springs 112*a* and 112*b* are placed, respectively, in the Y1 sides of bearings 66*a* and 67*a* of the sideboard parts 66 and 67.

Figure 12:
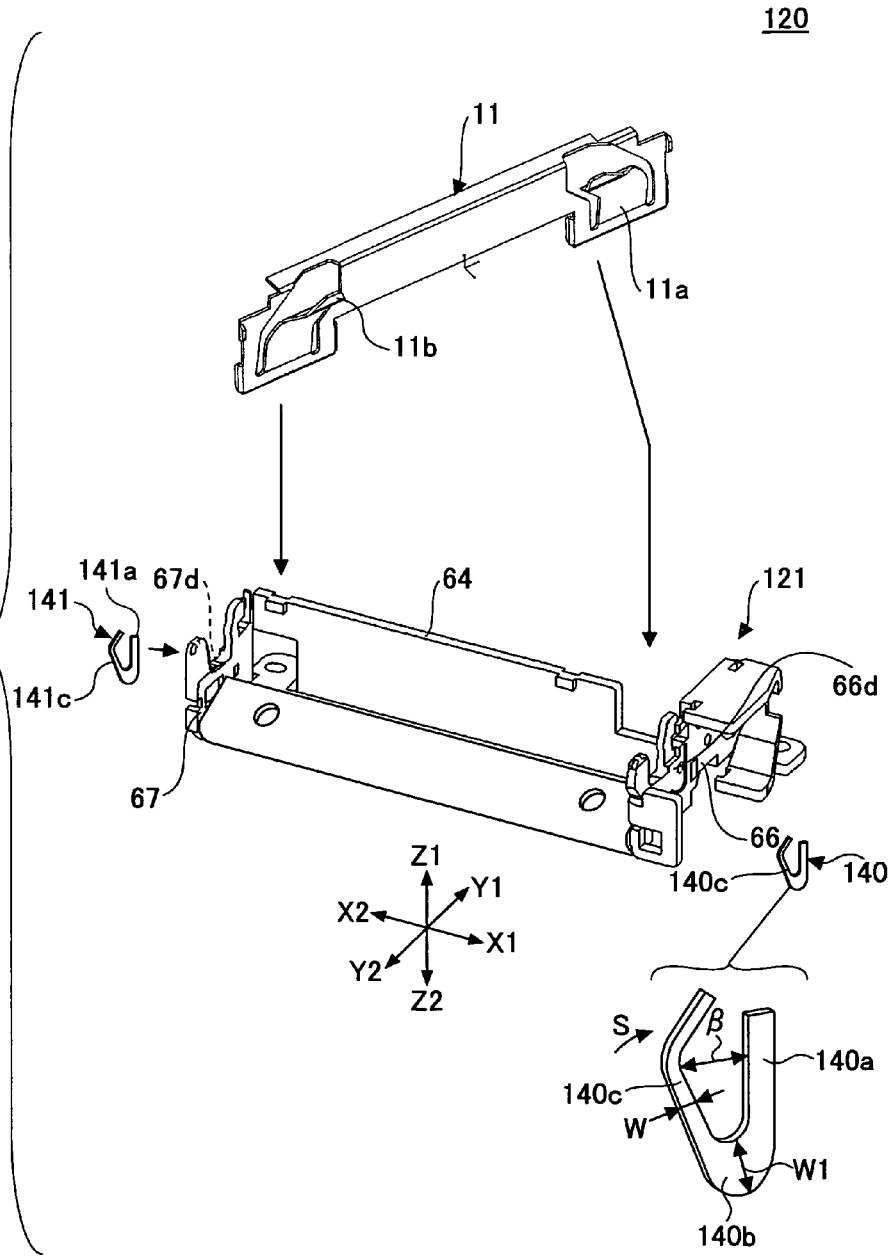
FIG. 12 is an exploded view of a frame 120 that is a third variation of the frame 61.

FIG. 12 is an exploded view of a frame 120 that is a third variation of the frame 61.

The frame 120 includes a frame body 121 made by press forming, and a plate spring part 11 and platen-roller-holding plate springs 140 and 141 attached to the frame body 121.

The frame body 121 has a configuration similar to that of the frame 61 shown in FIG. 9C except that the frame body 121 does not have the thermal-head-pressing plate springs 64*a* and 64*b* and the platen-roller-holding plate springs 66*c* and 67*c*. The frame body 121 may be made of aluminum because it has no plate spring. Plate spring sockets 66*d* and 67*d* for holding the platen-roller-holding plate springs 140 and 141 are formed, respectively, on the outer surfaces of sideboard parts 66 and 67.

The plate spring part 11 is attached to a backboard part 64 of the frame body 121 such that thermal-head-pressing plate springs 11*a* and 11*b* are arranged on the Y2 side of the backboard part 64.

The platen-roller-holding plate spring 140 is fit into the plate spring socket 66*d* such that a spring arm 140*c* of the plate spring 140 is positioned in the Y1 side of the bearing 66*a*.

The platen-roller-holding plate spring 141 is fit into the plate spring socket 67*d* such that a spring arm 141*c* of the plate spring 141 is positioned in the Y1 side of the bearing 67*a*.

For brevity, descriptions below are made using the platen-roller-holding plate spring 140. The platen-roller-holding plate spring 141 has substantially the same configuration and features as those of the platen-roller-holding plate spring 140.

The platen-roller-holding plate spring 140 is made by press-cutting sheet metal. As shown by the enlarged view in FIG. 12, the platen-roller-holding plate spring 140 is substantially U-shaped and includes a base arm 140*a*, a U-shaped part 140*b* extending from the Z2 end of the base arm 140*a*, and the spring arm 140*c* extending from one end of the U-shaped part 140*b*. The spring arm 140*c* is substantially V-shaped and elastically bends in the direction indicated by an arrow S. The base arm 140*a* and the spring arm 140*c* form an angle β.

Figure 2:
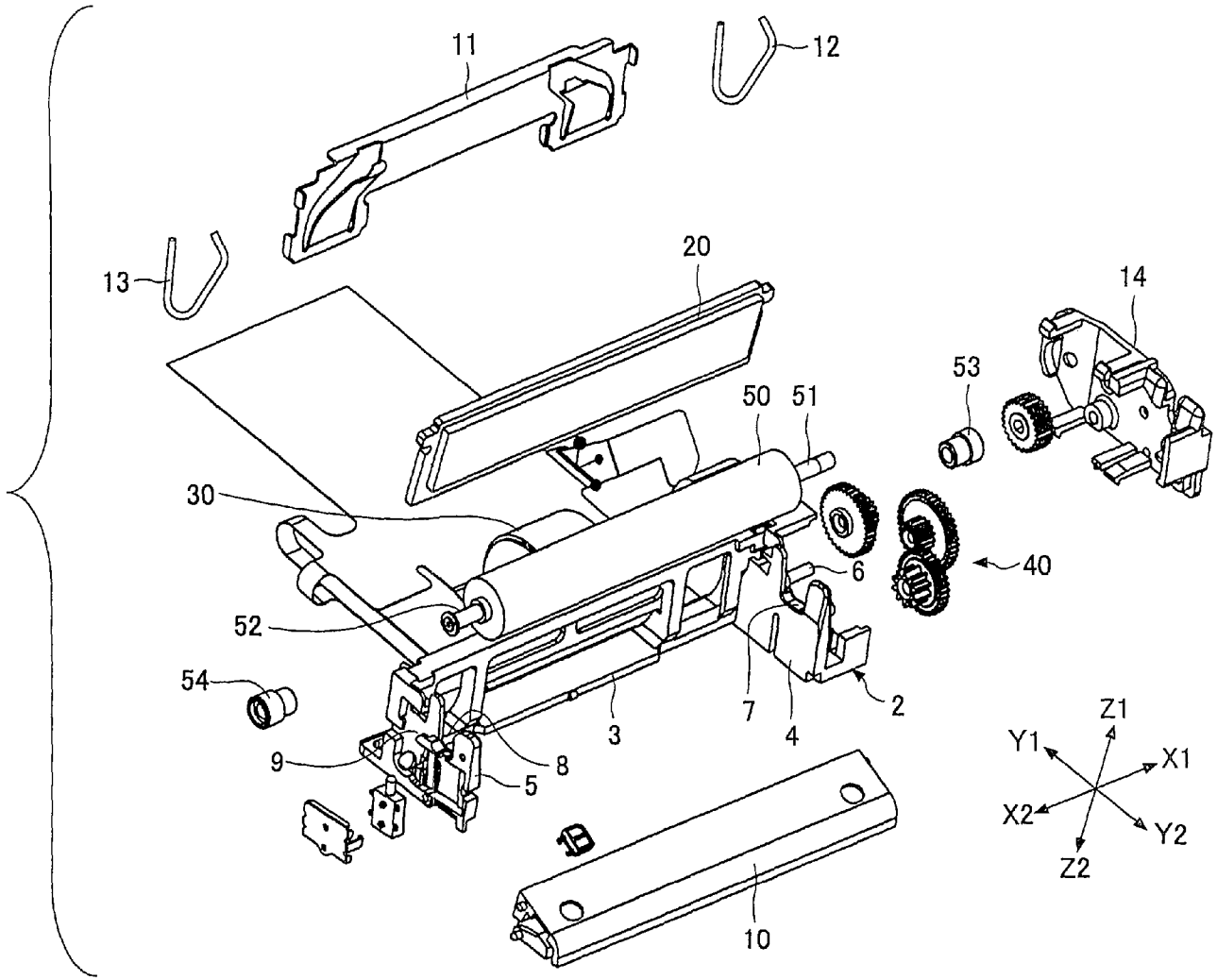
FIG. 2 is an exploded perspective view of the conventional thermal printer shown in FIG. 1.
Figure 3:
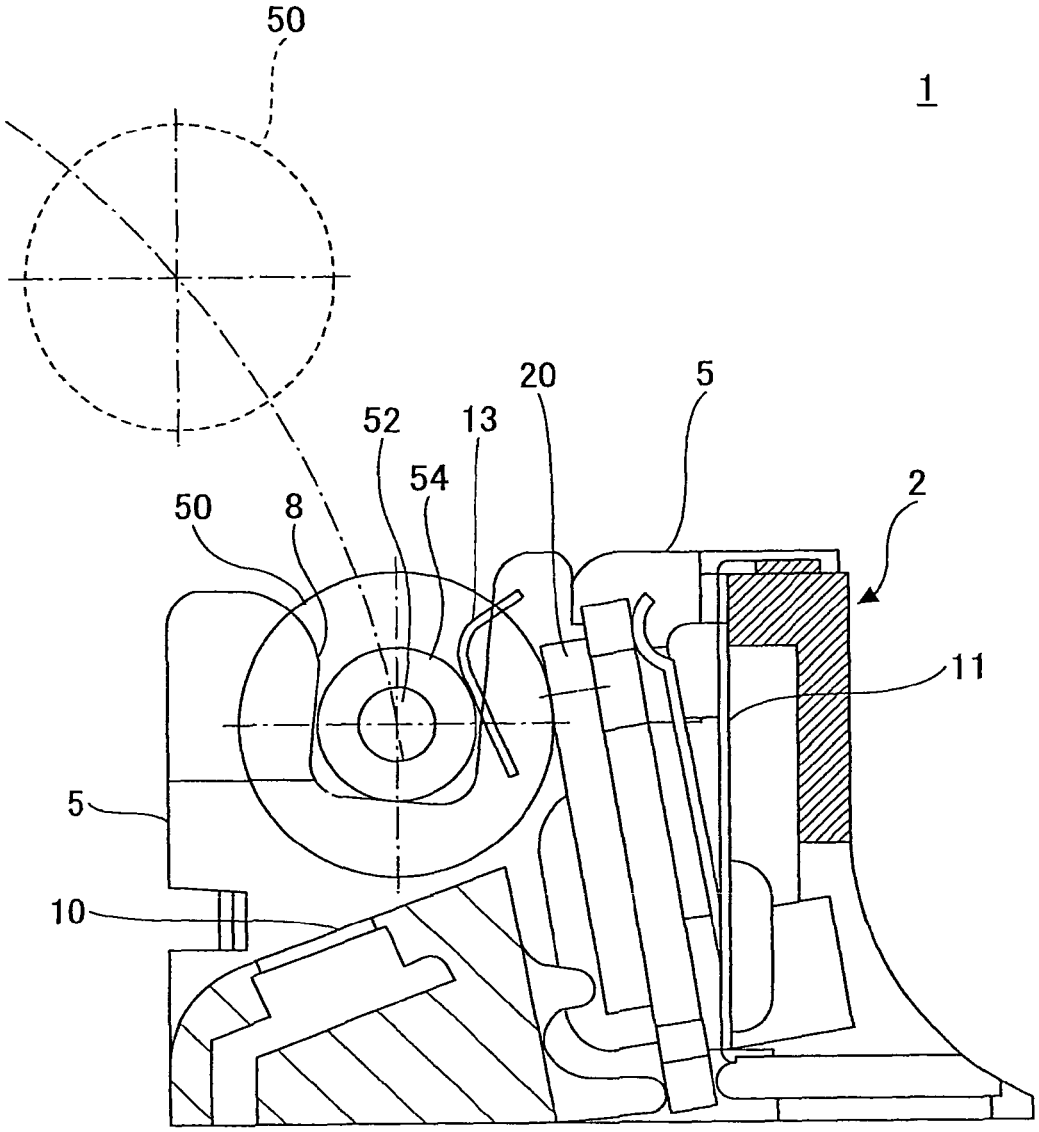
FIG. 3 is an enlarged cut-away side view of the conventional thermal printer shown in FIG. 1.

The platen-roller-holding plate spring 140 is made by press-cutting sheet metal, and has features as described below compared with the platen roller holding springs 12 and 13 shown in FIG. 2 which are made by bending wire springs.

The platen-roller-holding plate spring 140 has no spring-back and therefore can be manufactured with high dimensional accuracy.

Width W of any given portion of the plate spring 140 can be changed freely. In this embodiment, a width W1 of the U-shaped part 140*b*, which is subjected to stress, is larger than the widths of other parts.

No tool mark is formed on the bottom of the V-shape of the spring arm 140*c*. This prevents crack formation caused by stress concentration at a tool mark and therefore improves the reliability of the plate spring 140.

According to an embodiment of the present invention, a frame of a thermal printer is produced by press forming instead of die-casting as in a conventional thermal printer. This eliminates the need to remove burrs formed during a die-casting process from a frame. Also, producing a frame by press forming solves the problem of porosity formation, and therefore improves the reliability of the frame. Further, a press forming method does not require expensive die-casting dies and therefore reduces the cost of equipment for manufacturing thermal printers.

The present invention is not limited to the specifically disclosed embodiments, and variations and modifications may be made without departing from the scope of the present invention.

The present application is based on Japanese Priority Application No. 2007-270141 filed on Oct. 17, 2007 with the Japanese Patent Office, the entire contents of which are hereby incorporated herein by reference.

What is claimed is:

1. A printer, comprising:

a frame;

a thermal head for printing, the thermal head being attached to the frame;

a platen roller drive motor attached to the frame; a reduction gear train attached to the frame and configured to reduce the speed of rotation generated by the platen roller drive motor; and a platen roller detachably attached to the frame and configured to be driven by the platen roller drive motor via the reduction gear train and to feed paper while pressing the paper against the thermal head;

wherein the frame is produced by press-forming sheet metal and includes a horizontal plate part having a rectangular shape, a backboard part rising vertically from a back edge of the horizontal plate part, sideboard parts rising vertically from corresponding side edges of the horizontal plate part, a projecting part protruding outward from an edge of one of the sideboard parts and forming a surrounding part of a gearbox for housing the reduction gear train, and a paper guide part having a top portion and a bottom portion, the bottom portion being formed integrally with a front edge of the horizontal plate and bent backward forming an adjustable angle of inclination such that the top portion of the paper guide part extends above the horizontal plate part.

2. The printer as claimed in claim 1, wherein the backboard part of the frame includes a thermal-head-pressing plate spring that is formed by cutting out a portion of the backboard part and pulling up the cut-out portion and is configured to press a back side of the thermal head toward the platen roller.

3. The printer as claimed in claim 1, wherein the sideboard parts of the frame, respectively, include substantially U-shaped bearings for supporting bearing parts provided at corresponding ends of the platen roller and platen-roller-holding plate springs for holding the bearing parts in the respective bearings.

4. The printer as claimed in claim 1, wherein the paper guide part is positioned below the platen roller and configured to guide the paper being fed toward the thermal head.

5. The printer as claimed in claim 1, wherein the one of the sideboard parts of the frame includes a shaft part formed by drawing, the shaft part protruding outward and being configured to support the reduction gear train.

6. The printer as claimed in claim 1, wherein the frame further includes a cover part for covering an opening of the gearbox, the cover part being formed by press-forming and extending from the projecting part.

7. The printer as claimed in claim 1, further comprising:

a plate spring part attached to the backboard part of the frame and including a thermal-head-pressing plate spring configured to press a back side of the thermal head toward the platen roller, and platen-roller-holding plate springs formed at corresponding ends of the plate spring part and configured to hold bearing parts provided at corresponding ends of the platen roller in substantially U-shaped bearings of the sideboard parts.

8. The printer as claimed in claim 1, further comprising:

substantially U-shaped platen-roller-holding plate springs made by press-cutting sheet metal and attached to the corresponding sideboard parts of the frame; wherein each of the platen-roller-holding plate springs includes a base arm, a U-shaped part extending from one end of the base arm, and a spring arm extending from one end of the U-shaped part; and the spring arms of the platen-roller-holding plate springs are configured to hold bearing parts provided at corresponding ends of the platen roller in substantially U-shaped bearings of the sideboard parts.

* * * * *